US006389093B1

(12) United States Patent
Gluschke et al.

(10) Patent No.: US 6,389,093 B1
(45) Date of Patent: May 14, 2002

(54) STORAGE/TRANSPORT CONTAINER FOR SPENT NUCLEAR-FUEL ELEMENTS

(75) Inventors: Konrad Gluschke, Wickede; Rudolf Diersch, Essen; Dieter Methling, Hattingen; Joachim Heidenreich, Oer-Erkenschwick, all of (DE)

(73) Assignee: GNB Gesellschaft fur Nuklear-Behalter mbH, Essen (DE)

( * ) Notice: Subject to any disclaimer, the term of this patent is extended or adjusted under 35 U.S.C. 154(b) by 0 days.

(21) Appl. No.: 09/596,421

(22) Filed: Jun. 19, 2000

(30) Foreign Application Priority Data

Jun. 19, 1999 (EP) ..... 99111839

(51) Int. Cl.[7] ..... G21C 19/07; G21F 5/00
(52) U.S. Cl. ..... 376/272; 250/506.1
(58) Field of Search ..... 376/272; 250/506.1, 250/507.1

(56) References Cited

U.S. PATENT DOCUMENTS 3,005,105 A * 10/1961 Lusk ..... 250/108
3,930,166 A * 12/1975 Bochard ..... 250/506
4,339,411 A * 7/1982 Knackstedt et al. ..... 376/272
4,458,458 A * 7/1984 Orii ..... 52/173 R
4,590,383 A * 5/1986 Machado et al. ..... 250/506.1
4,752,437 A * 6/1988 Ito et al. ..... 376/272
4,950,426 A * 8/1990 Markowitz et al. ..... 252/633
4,987,313 A * 1/1991 Baatz et al. ..... 250/506.1
4,997,618 A * 3/1991 Efferding ..... 376/272
5,641,970 A * 6/1997 Taniuchi et al. ..... 250/506.1
5,887,042 A * 3/1999 Akamatsu et al. ..... 376/272
6,187,395 B1 * 2/2001 Canzler et al. ..... 428/34.1
6,195,404 B1 * 2/2001 Lemogne et al. ..... 376/272

FOREIGN PATENT DOCUMENTS

WO 98 59344 12/1998

* cited by examiner

*Primary Examiner*—Charles T. Jordan
*Assistant Examiner*—Kimberly S. Smith
(74) *Attorney, Agent, or Firm*—Herbert Dubno; Andrew Wilford

(57) ABSTRACT

A transport/storage container for spent nuclear-fuel elements has spaced inner and outer side walls defining an annular space extending along an axis, a cover at one end of the side walls, a floor at an opposite end of the side walls, and a plurality of heat-conducting elements in the space and each having one edge fixed, for instance by welding or bolting, to one of the side walls and an opposite edge bearing radially elastically on the other of the side walls.

7 Claims, 4 Drawing Sheets

STORAGE/TRANSPORT CONTAINER FOR SPENT NUCLEAR-FUEL ELEMENTS

FIELD OF THE INVENTION

The present invention relates to a storage/transport container for nuclear elements. More particularly this invention concerns such a container for heat-evolving nuclear-fuel elements.

BACKGROUND OF THE INVENTION

A transport/storage container for spent nuclear-fuel elements normally has spaced steel inner and outer side walls defining an annular space extending along an axis, a cover at one end of the side walls, a floor at an opposite end of the side walls, and a filler such as concrete in the space between the inner and outer side walls. Normally such a container is cylindrical and its interior is filled with heat-evolving radioactive waste, normally spent fuel rods that may be held in special baskets as described in commonly owned patent application Ser. No. 09/550,742 (now U.S. Pat. No. 6,256,363 issued Jul. 3, 2001).

The contents of such a container evolve heat which must be dissipated. Accordingly it is known to install a first array of heat-conducting reinforcement rods inside the inner side wall extending parallel to the container axis, a second array of such rods in the concrete-filled space between the inner and outer side walls, and short connecting rods extending through the inner side wall between the first and second arrays. Such a system conducts the heat to the cover and floor, but little heat is transmitted to the outer side wall so that the container's contents can get excessively hot in center regions of the container.

OBJECTS OF THE INVENTION

It is therefore an object of the present invention to provide an improved transport/storage container for heat-evolving radioactive waste.

Another object is the provision of such an improved transport/storage container for heat-evolving radioactive waste which overcomes the above-given disadvantages, that is which surely and efficiently conducts heat from the contents of the container to the outer side wall which typically is immersed in a body of water designed to carry away such heat.

SUMMARY OF THE INVENTION

A transport/storage container for spent nuclear-fuel elements has according to the invention spaced inner and outer side walls defining an annular space extending along an axis, a cover at one end of the side walls, a floor at an opposite end of the side walls, and a plurality of heat-conducting elements in the space and each having one edge fixed, for instance by welding or bolting, to one of the side walls and an opposite edge bearing radially elastically on the other of the side walls.

According to the invention therefore one end of each metal element is firmly connected to the inner side wall or outer side wall and its other element abuts the opposite part of the container side wall, i.e. the inner side wall or outer side wall, under prestress without a firm connection. The metal elements therefore resiliently abut the opposite part of the container side wall. A "firm connection" to the inner side wall or outer side wall according to the invention means a connection which cannot be easily broken, particularly a connection by welding or screwing or bolting. "Abutting under prestress" according to the invention, on the other hand, means that there is no firm connection between the relevant end of the metal element and the inner side wall or outer side wall but that the end is simply pressed by the prestressing force.

Optionally according to the invention the metal elements are connected to metal elements for reinforcing the inner side wall and/or outer side wall. The reinforcing elements are preferably U-profiles, both arms of the U advantageously projecting into the space between the inner side wall and the outer side wall. In one embodiment of the invention the ends of the metal elements are connected to respective arms of the U-shaped reinforcing elements. Optionally according to the invention the reinforcing elements are of metal, preferably steel. The reinforcing elements, preferably U-profiles, stiffen the outer side wall and inner side wall and also bond the filler, preferably concrete. The reinforcing elements, preferably U-profiles, therefore have a strength-increasing effect. In a preferred embodiment U-profiles are provided at least on the inside of the outer side wall. Advantageously the spacing between the U-profiles is less than 15 cm.

In the last-mentioned preferred embodiment the reinforcing elements on the inner side wall need not be U-profiles. Alternatively according to the invention the reinforcing elements on the inner side wall are in the form of strips and are attached to the inner side wall, e.g. by screws. In a preferred embodiment the screw connection can be by nuts and bolts, the bolts being preferably directly welded to the outer side wall or inner side wall. Besides serving as stiffening elements, another function of the reinforcing elements is to transmit heat.

In a preferred embodiment of the invention one end of each metal element is firmly connected to the inner side wall and the other end abuts the outer side wall under prestress, thus forming a heat-conducting connection. Preferably each metal element is firmly connected to an element for reinforcing the inner side wall. In a highly preferred embodiment which is particularly important according to the invention, the metal elements are metal sheets. The firm connection is a welded connection or a screw connection. Optionally according to the invention the reinforcing elements are U-profiles mounted on the outer face of the inner side wall, and the metal elements or metal sheets are fastened to respective arms of the U-shaped profiles on the inner side wall.

The reinforcing elements provided on the outer face of the inner side wall may in principle have a different shape. For example according to the invention the reinforcing elements on the inner side wall may alternatively be reinforcing strips to which the metal elements or metal sheets can advantageously be screwed, or directly screwed to bolts welded to the inner side wall. According to a highly preferred embodiment of the invention the other ends of the metal elements, preferably metal sheets, abut under prestress against elements for reinforcing the outer side wall, the reinforcing elements being distributed over the periphery of the container on the inner surface of the outer side wall. Preferably according to the invention the reinforcing elements are U-profiles and advantageously the other end of each metal element or metal sheet abuts an arm of a U-profile under prestress. The reinforcing elements, preferably U-profiles, extend over the entire height of the container parallel to the central axis of the container.

With regard to the firm connection between one end of each metal element and the inner side wall, there are two preferred embodiments. In one preferred embodiment, use is made of steel metal sheets having a thickness of 6 mm to 8 mm. In a first option according to the invention, these metal sheets are welded to U-profiles on the inner container. The metal sheets can also be screwed to the inner container via reinforcing strips. Another possibility is to screw the metal sheets to bolts welded to the inner container. In the two last-mentioned embodiments with screwing, the metal sheets are advantageously bent before assembly, the bent arms being preferably drilled out for screwing. In another preferred embodiment of the invention, the metal sheets are of copper, preferably between 1 mm and 3 mm thick. According to a feature of this embodiment, the copper metal sheets are screwed to reinforcing strips on the inner container. According to another feature of this embodiment the copper metal sheets are screwed to bolts welded to the inner container.

According to another embodiment of the invention the metal elements, preferably metal sheets, are firmly connected alternately to the inner side wall or outer side wall, preferably by screwing. In a preferred embodiment of the invention the container according to the invention is manufactured as follows: first the metal elements, preferably metal sheets, are firmly connected at one end to the inner side wall, e.g. by welding. Advantageously the inner side wall has reinforcing elements in the form of U-profiles. One end of each metal element is fixed to the U-profiles, preferably by welding. The metal elements are then bent, preferably in pairs toward one another, and temporarily fixed in this position. Next the outer side wall is inverted over the subassembly formed by the inner side wall and the metal elements fastened thereto. The temporary fastening between the metal elements is then released so that the other ends of the metal elements now abut the outer side wall under prestress. Then the space is filled with concrete which is allowed to cure. Preferably the other ends of the metal elements are in resilient contact with reinforcing elements, preferably U-profiles, on the inner surface of the outer side wall. As previously stated, the above-mentioned metal elements are preferably metal sheets. According to a preferred embodiment of the invention the surfaces of the metal sheets are disposed at right angles to the container floor or at right angles to the container cover. The surfaces of the metal sheets preferably extend approximately in the radial direction relative to the central axis of the container in the space between the inner side wall and the outer side wall. In an embodiment of the invention the metal sheets are straight, i.e. not bent or not substantially bent, relative to. the direction of the connection between the inner side wall and the outer side wall. Alternatively the metal sheet can be a number of parts aligned axially along the container. According to an embodiment of the invention a one-piece metal sheet extends continuously in the space from the container floor to the container cover. In a highly preferred embodiment of the invention, portions of metal plates are bent away from the metal-plate surface.

In other words, according to the invention portions of the metal plates are bent like windows at a certain angle from the metal-sheet surface. Advantageously the metal-sheet portions or windows are rectangles, and only one side of the rectangle is connected to the metal sheet. Optionally according to the invention, the bent metal-sheet portions have the same orientation as the metal-sheet surface to the container floor or container cover and are formed at right angles thereto. In this embodiment of the invention, advantageously the top edge and the floor edge of the metal-sheet portions are horizontal. To this extent, preferably the top edge and floor edge of a metal-sheet portion are disposed parallel to the top edge of the entire metal sheet. Alternatively according to the invention the metal-sheet portions are angled, i.e. are bent at an angle away from the metal sheet. In this embodiment of the invention the top edge and the floor edge of each portion are advantageously disposed at an angle to the horizontal. In other words the angle between the top edge of a metal-sheet portion and a horizontal line or the angle between the floor edge of the portion and a horizontal line is greater than zero. In one embodiment of the invention at least some of the metal-sheet portions are disposed at an angle as mentioned. Preferably a number of bent metal-sheet portions are superposed in a metal sheet in the vertical direction, i.e. between the container floor and the container cover. Optionally according to the invention, two or three bent metal-sheet portions are disposed side by side at the same height on the metal sheet. If two bent portions in a metal sheet are present at the same height according to the invention these two portions are disposed at an angle from the metal sheet in opposite directions. The angle between the metal-sheet portion or window and the metal-sheet surface is preferably 15° to 30°, very preferably 20° to 25°. The height of the bent metal-sheet portions or windows, relative to the longitudinal direction of the container, is preferably 30 mm to 70 mm, more preferably 40 mm to 60 mm, very preferably about 50 mm. The length of the bent metal-sheet portions or windows depends basically on the width of the space between the inner side wall and the outer side wall. It is for example 100 mm to 150 mm, preferably 120 mm to 130 mm. In the case of bent metal-sheet portions or windows superposed in the metal sheet, the height relative to the longitudinal direction of the container of the webs free from metal-sheet portions is preferably 30 mm to 50 mm, very preferably 35 mm to 45 mm. The bent metal-sheet portions or windows effectively bond the concrete poured between the metal sheets. The bent portions also serve as passive mixing elements when the concrete is poured into the space between the inner side wall and outer side wall.

In a preferred embodiment of the invention, after the outer side wall has been installed, only dry aggregate is first poured into the space between the inner side wall and the outer side wall. The bent metal-sheet portions serve as surprisingly effective passive elements for mixing the concrete aggregate for pouring in. In particular the previously described sheet-metal portions disposed at an angle serve as very effective mixing elements. The aggregates are preferably barite (barium sulphate) and iron granulate. After, and only after, the dry aggregate has been poured in, the binder is injected, preferably under high pressure, into the space between the inner side wall and outer side wall. A corresponding method is described in WO 98/59346. Optionally according to the invention, the container is up-ended with its floor upward when filled with the dry aggregate and binder. It has already been emphasized that the bent sheet-metal portions are effective passive mixing elements. The metal sheets according to the invention, with or without bent portions, are also suitable in particular for transmitting the vibration of a vibrator placed against them, so that the dry aggregate or concrete mixture can be additionally compacted. More particularly the heavy concrete can without difficulty be given a density of at least 4.1. Densities of over 5 can also be obtained. The metal sheets according to the invention, with or without the bent portions, are thus suitable vibration-transmitting elements for effectively reducing the volume of the gaps between the particles of aggregate.

In a preferred embodiment of the invention the metal sheets have a thickness of 1 mm to 8 mm, preferably 3 mm to 6 mm. Optionally according to the invention, the bent metal-sheet portions can also have a corresponding thickness. In an embodiment of the invention, the metal sheets are laminated. According to the invention, therefore, a metal sheet can have a sandwich structure. In a preferred embodiment the metal sheets are in two layers, the two layers being of different metals. One such two-layer metal sheet can more particularly comprise a steel layer and a superposed copper layer. The steel layer substantially determines the strength of the metal sheet whereas the copper layer is mainly responsible for the thermal conductivity of the sheet. Metal sheets of pure copper or copper alloys can also be used according to the invention. Optionally also according to the invention, the thickness of the metal sheet is adjusted in dependence on the thermal conductivity of the metal or metals used. In a particularly important embodiment of the invention, the container floor comprises an inner floor and an outer floor and, as before, heat-dissipating metal sheets are provided between the inner floor and the outer floor. According to the invention the inner floor is connected to the inner side wall of the container. Also according to the invention, the outer floor is connected to the outer side wall of the container. Preferably, metal sheets disposed between the inner floor and outer floor are firmly connected to the inner floor, preferably by welding or screwing. These metal sheets are connected to the outer floor in heat-conducting manner. Advantageously the metal sheets disposed between the inner floor and outer floor have the same orientation as the metal sheets in the space between the inner side wall and outer side wall and, like the other metal sheets, are disposed at right angles to the container floor. In a very preferred embodiment of the invention, the metal sheets disposed between the inner floor and the outer floor likewise have bent portions or windows. The metal sheets in the floor region serve as heat-dissipating elements and also stiffen the container floor. Optionally according to the invention, the space between the inner floor and outer floor is likewise filled with concrete.

The invention is based on the discovery that surprisingly effective heat dissipation from the interior of the container is obtained if the metal sheets according to the invention are provided between the inner side wall and outer side wall. As a result of the arrangement of these metal sheets according to the invention, effective heat-conducting contact between the inner side wall and outer side wall is ensured over the entire height of the transport and/or storage container, so that the heat can be efficiently dissipated. Even if the inner side wall or outer side wall is irregular, e.g. non-round, heat-conducting contact is always maintained owing to the construction according to the invention. Owing to the optimum heat dissipation, a container according to the invention can in principle hold higher-power combustion elements than a container of comparable size known in the art. The metal sheets according to the invention additionally serve as effective mixing elements when the filler is poured in. This applies particularly to the preferred embodiment of the invention wherein the metal sheets have bent portions. The invention also has the considerable advantage that the transport and/or storage container according to the invention can be produced in very easy, uncomplicated, and consequently economic manner.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
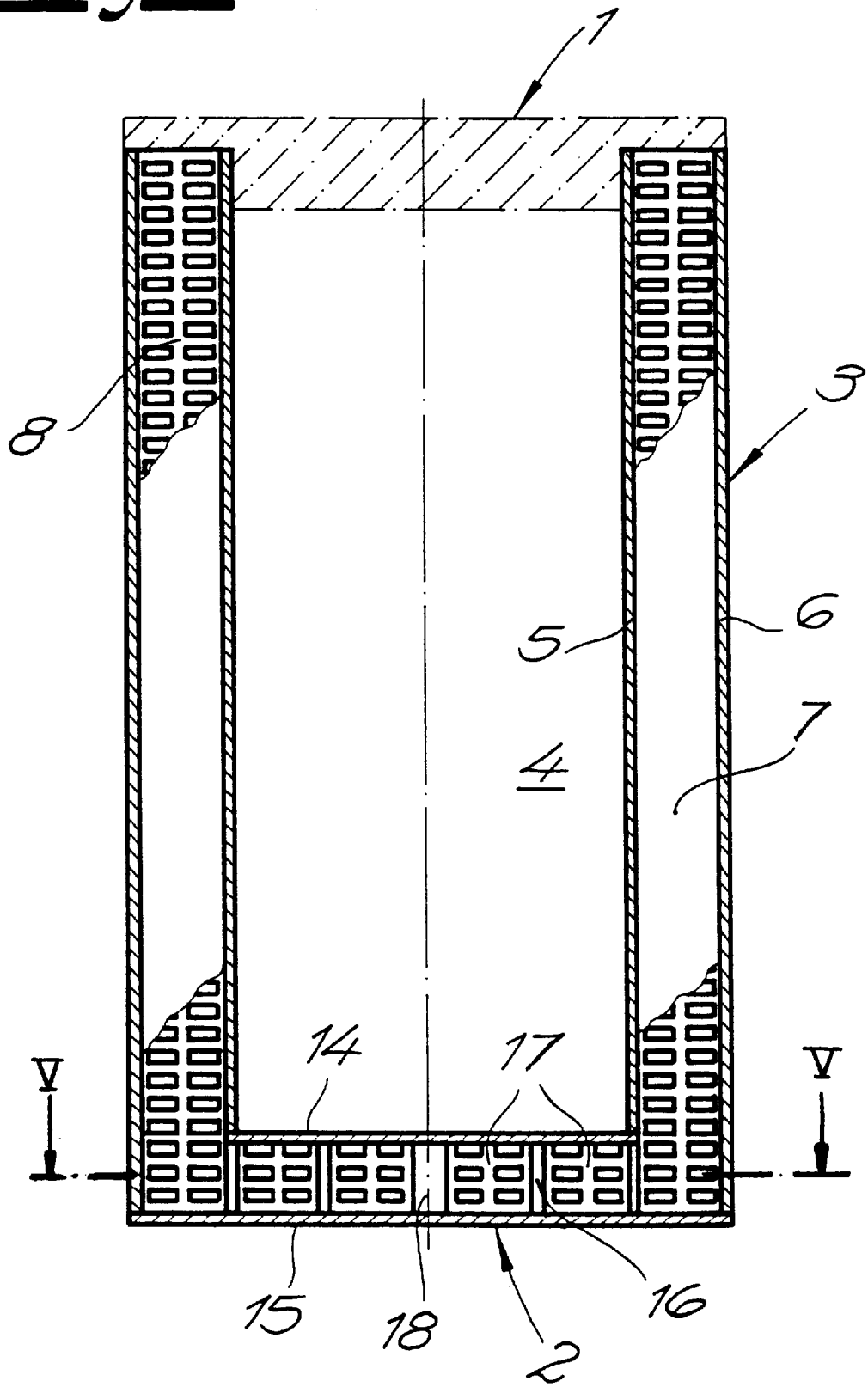
FIG. 1 is a small-scale vertical section through the container according to the invention.
Figure 2:
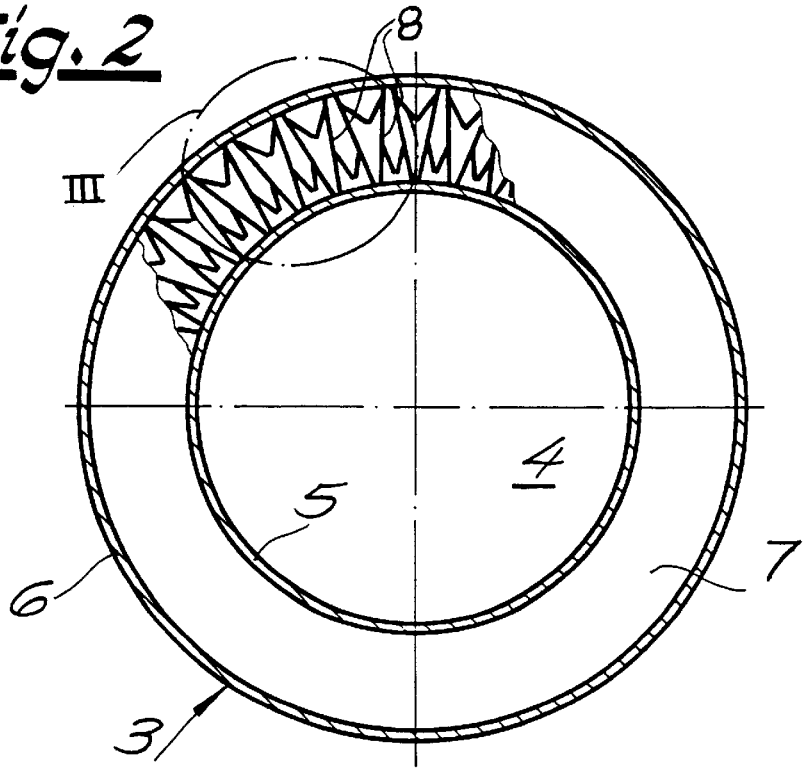
FIG. 2 is a top view of the container with the cover removed.

As seen in the drawing a transport and/or storage container for spent fuel elements has a cover 1, a floor 2, a cylindrical side wall 3 and an interior 4 centered on a normally upright axis 18. The side wall 3 comprises an inner side wall 5 bounding the container interior 4 and an outer side wall 6 offset outward from the inner side wall 3. A space 7 between the inner side wall 5 and the outer side wall 6 is filled with heavy concrete shown partially at 20 in FIG. 3.

According to the invention the inner side wall 5 is connected to the outer side wall 6 by heat-dissipating sheetmetal elements 8. One edge of each metal sheet 8 is firmly connected to the inner side wall 5 by welding. As shown particularly in FIG. 3, reinforcing elements in the form of U-profiles 9, 10 are fastened to the outer surface of the inner side wall 5 and to the inner surface of the outer side wall 6. The edges of the metal sheets 8 are connected to the U-profile 9 fastened to the inner side wall 5 by welding to an arm 11 of the U-profile 9. The other edge of each of the metal sheet 8, on the other hand, abuts a respective arm 12 of the outer side wall 6 under prestress, thus forming a heat-conducting contact. In this manner heat is conducted between the inner side wall 5 and outer side wall 6. The metal sheets 8 are uniformly distributed over the entire periphery of the container between the inner side wall 5 and the outer side wall 6. The U-profiles 9, 10 extend over the entire height of the container, i.e. from the cover 1 to the floor 2 and they are angularly uniformly spaced, with the outer profiles 10 being of course spaced somewhat more widely than the inner profiles 9 so that they strengthen and reinforce the walls 5 and 6.

Figure 3:
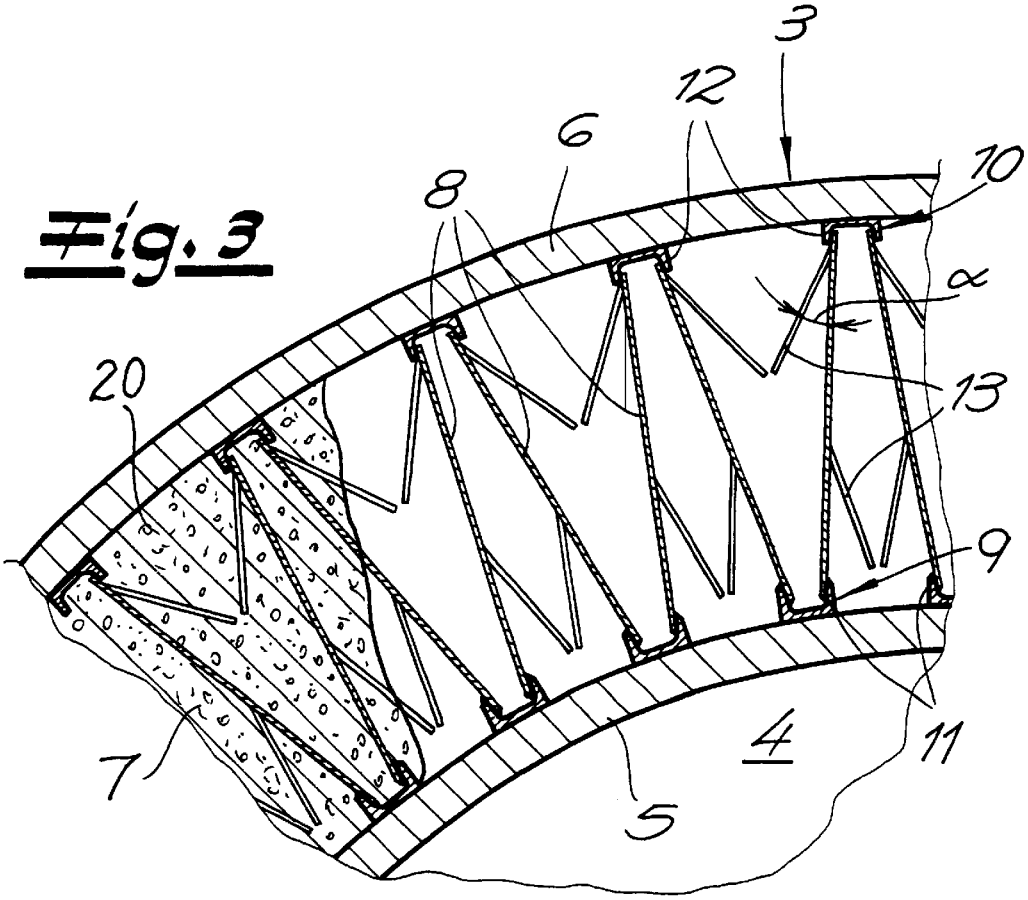
FIG. 3 is a large-scale view of the detail indicated at III in FIG. 2.
Figure 4:
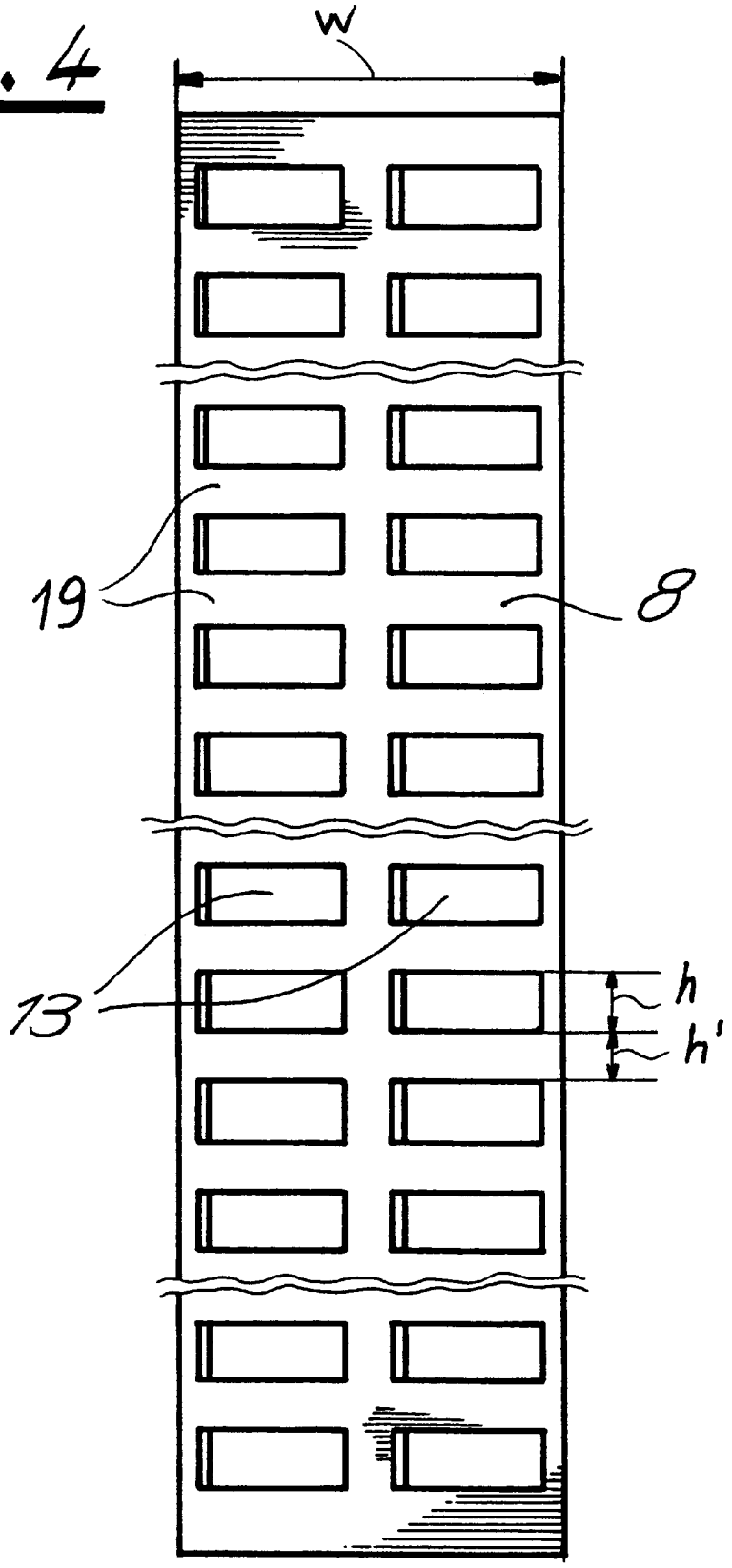
FIG. 4 is a side view on one of the heat-transfer elements according to the invention.

As shown in FIG. 3, the metal sheets 8 connected to the U-profiles 9, 10 form trapezoidal spaces seen in plan view for receiving the filler, usually concrete. If, advantageously and as in the exemplified embodiment, two adjoining metal sheets 8 are welded to the same U-profile 9 on the inner side wall 5, the metal sheets 8 abut different neighboring U-profiles 10 on the outer side wall 6. The surface of a metal sheet 8 is aligned at a right angle to the container floor 2 and to the container cover 1. According to the invention the metal sheets 8 are provided throughout from the cover 1 to the floor 2 in the annular space 7. Consequently the height of the preferred metal sheets 8 is substantially equal to the height of the container, particularly the height of the inner side wall 5.

Rectangular portions or tabs 13 are bent at an angle from the metal sheets, bent out like awnings or windows. FIG. 3 shows how a plurality of pairs of bent metal-sheet portions 13 are disposed one above the other in a metal sheet 8. Each pair of bent metal-sheet portions 13 is disposed at the same height on the metal sheet 8. In the embodiment the two metal-sheet portions 13 of each pair are bent in opposite directions from the plane of the respective sheet 8, through an angle $\alpha$ of 22° to 24° away from the metal sheet 8. The height h of a bent metal-sheet portion or window 13 is 50 mm, whereas the overall width w of one of the sheets 8 is 125 mm. The height h' of webs 19 between superposed bent metal-sheet portions 13 is 40 mm. The metal sheets 8 and the bent portions 13 have a thickness of 2 mm.

Figure 5:
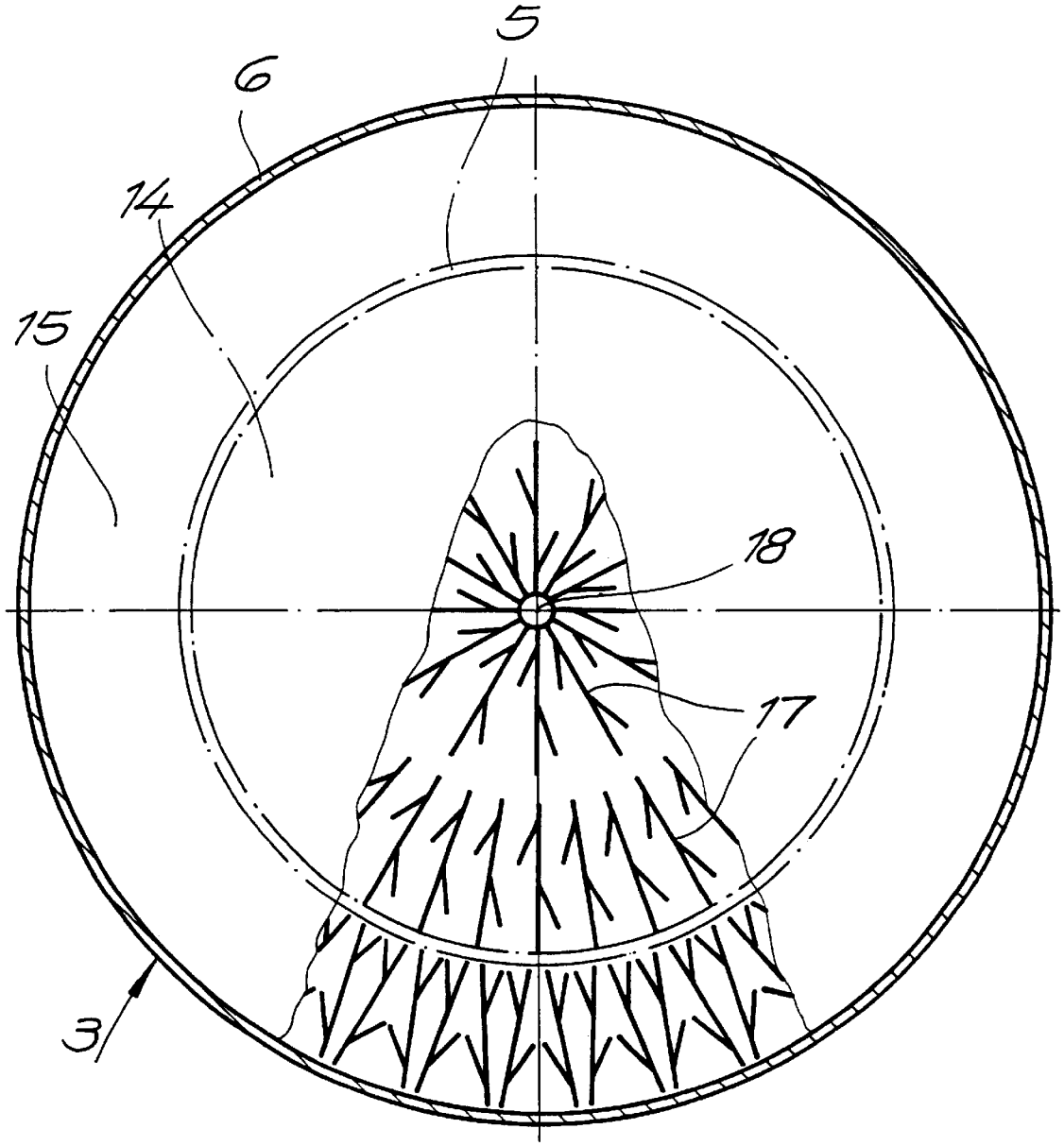
FIG. 5 is an end/sectional view taken generally along line V—V of FIG. 1.

The container floor 2 comprises an inner floor wall 14 and an outer floor wall 15 and heat-dissipating metal sheets 17 are likewise provided in a space 16 between the inner floor wall 14 and outer floor wall 15 (see FIG. 5). The inner floor wall 14 is connected to the inner side wall 5 and the outer floor wall 15 is connected to the outer side wall 6. The metal sheets 17 are firmly connected to the inner floor wall 14, preferably by welding, and they abut the outer floor wall, forming a heat-conducting contact.

As shown in FIG. 5, two rows of metal sheets 17 are disposed concentrically around the central axis 18. Both the space 16 between the inner floor wall 14 and the outer floor wall 15 and the space 7 between the inner side wall 5 and the outer side wall 6 are filled with heavy concrete.

We claim:

1. A transport/storage container for spent nuclear-fuel elements, the container comprising:

spaced inner and outer side walls defining an annular space extending along an axis and having upper and lower ends a cover at the upper end of the side walls;

a floor at the lower end of the side walls; and a plurality of sheet-metal heat-conducting elements in the annular space, each having one edge fixed to one of the side walls and an opposite edge bearing radially on the other of the side walls, and each having portions punched out from and extending at an acute angle to the respective heat-conducting element.

2. The transport/storage container defined in claim 1 wherein the one side wall to which the one edges of the heat-conducting elements are fixed is the inner side wall.

3. The transport/storage container defined in claim 1 wherein the floor extends substantially perpendicular to the axis and the heat-conducting elements extend substantially perpendicular to the floor.

4. The transport/storage container defined in claim 1 wherein the heat-conducting elements have a thickness of between 1 mm and 8 mm.

5. The transport/storage container defined in claim 1 further comprising a mass of concrete filling the annular space between the side walls and around the heat-conducting elements.

6. A transport/storage container for spent nuclear-fuel elements, the container comprising:

spaced inner and outer side walls defining an annular space extending along an axis and having upper and lower ends a cover at the upper end of the side walls;

a floor at the lower end of the side walls and including an inner floor wall connected to the inner side wall and an outer floor wall spaced from the inner floor wall and connected to the outer side wall;

a plurality of side heat-conducting elements in the annular space and each having one edge fixed to one of the side walls and an opposite edge bearing radially on the other of the side walls; and a plurality of floor heat-conducting elements in the annular space between the inner and outer floor walls and each having one edge fixed to one of the floor walls and an opposite edge bearing axially on the other of the floor walls.

7. A transport/storage container for spent nuclear-fuel elements, the container comprising:

spaced inner and outer side walls defining an annular space extending along an axis and having upper and lower ends respective inner and outer sets of axially extending U-shaped profiles fixed to the inner and outer side walls and having arms extending radially therefrom;

a cover at the upper end of the side walls;

a floor at the lower end of the side walls; and a plurality of heat-conducting elements in the annular space and each having one edge welded to respective arms of the profiles of one of the side walls and an opposite edge bearing radially on the arms of the profiles of the other of the side walls.

* * * * *